United States Patent [19]

Spreadbury

[11] 4,350,934

[45] Sep. 21, 1982

[54] DISCHARGE DEVICE BALLAST COMPONENT WHICH PROVIDES BOTH VOLTAGE TRANSFORMATION AND VARIABLE INDUCTIVE REACTANCE

[75] Inventor: Robert J. Spreadbury, Murrysville, Pa.

[73] Assignee: Westinghouse Electric Corp., Pittsburgh, Pa.

[21] Appl. No.: 171,589

[22] Filed: Jul. 23, 1980

[51] Int. Cl.[3] ..... H05B 41/16

[52] U.S. Cl. ..... 315/282; 315/194; 315/284; 315/287

[58] Field of Search ..... 315/282, 287, 285, 194, 315/284

[56] References Cited

U.S. PATENT DOCUMENTS

| | | | |
|---|---|---|---|
| 848,935 | 2/1907 | Troy | 315/282 |
| 965,168 | 7/1910 | Eastham | 315/282 |
| 2,311,543 | 2/1943 | Horn | 315/278 |
| 2,392,845 | 1/1946 | Foerste | 315/282 |
| 3,873,910 | 3/1975 | Willis | 315/278 |
| 4,037,148 | 7/1977 | Owens et al. | 315/194 |

*Primary Examiner*—Harold A. Dixon
*Attorney, Agent, or Firm*—W. D. Palmer

[57] ABSTRACT

Composite structure for use as an HID device ballast component and which performs the dual functions of voltage transformation and provision of ballasting reactance which can be controllably shifted in value. A multi-leg magnetic structure has a primary winding carried on a first leg thereof and an output winding carried on a second leg thereof. A control winding is carried on a third leg and a gap of predetermined dimensions is provided in the magnetic path which includes the third leg. The magnetic core member and the windings carried thereon display leakage flux paths of predetermined total permeance. A bilateral switch connects to the control winding and is operable to be closed once each half cycle of normal lamp operation. With the control winding closed, the counter mmf generated in the third leg decreases the inductive reactance of the structure by a predetermined amount, with the inductive reactance of the structure essentially established by the permeance of the leakage paths. With the control winding open, the inductive reactance of the structure is established both by the reactance of the wound third leg and the permeance of the leakage paths. Thus, the effective ballasting inductive reactance can be controllable varied between two predetermined values in order to control the performance of the ballasted device and the composite structure also provides voltage transformation.

8 Claims, 12 Drawing Figures

DISCHARGE DEVICE BALLAST COMPONENT WHICH PROVIDES BOTH VOLTAGE TRANSFORMATION AND VARIABLE INDUCTIVE REACTANCE

BACKGROUND OF THE INVENTION

This invention relates to a ballasting component for a discharge device and, more particularly, to a composite structure for use as an HID device ballasting component which performs the dual functions of voltage transformation and provision of ballasting inductive reactance which can be controllably shifted in value.

Discharge devices normally require some type of ballasting or current limiting feature in order to prevent a runaway discharge due to the negative volt-ampere characteristics of such devices. In recent years the use of so-called high-pressure sodium or sodium-mercury lamps has expanded greatly because of the high efficiency and long life which can be obtained with such lamps. These lamps normally display a rising voltage characteristic throughout lamp life. Unless some provision is made to control the power input to the lamp, this rising voltage characteristic will reflect in increased wattage input into the lamp which, if it is not controlled within predetermined limits, can impair the performance of the lamp. The performance of such lamp can also be adversely affected by line voltage variations which are reflected as substantially increased or decreased power consumption by the operating lamp.

In U.S. Pat. No. 4,162,429, dated July 24, 1979 to Elms et al. is disclosed a ballast circuit which accurately regulates the wattage drawn by an operating HID lamp and particularly a so-called high-pressure sodium lamp. This circuit senses both the line voltage and lamp voltage in order to close a bilateral switch at a variable but predetermined time in each half cycle of AC energizing potential. The switch on closing serves to close a control winding in a variable inductance device such as is disclosed in U.S. Pat. No. 4,162,428, dated July 24, 1979 to Elms. While this combination of control circuit and variable inductor works very effectively, some separate type of voltage transformation is needed unless the device is to be operated across a 240 volt or higher voltage line.

U.S. Pat. No. 3,873,910, dated Mar. 25, 1975 to Willis, Jr. disclosed a variable inductor which includes a main winding and a control winding positioned on opposite sides of a gapped shunt. The control winding is adapted to be closed by a gate-actuated AC switch, and upon closing, the inductance of the variable inductor is decreased by a predetermined amount, thereby controlling the power input to the ballasted lamp. U.S. Pat. No. 4,037,148, dated July 19, 1977 to Owens disclosed a ballast device especially adapted to operate with a variable inductor as described in the foregoing U.S. Pat. No. 3,873,910 to ballast a high-pressure sodium-discharge lamp wherein a non-linear amplifier is incorporated in circuit. For actual control, lamp voltage and line voltage are sensed and these voltage signals are combined in a programmable uni-junction transistor to control the firing time thereof, and thus the actuation of the gate-controlled switch. Such a circuit normally provides voltage transformation by means of an autotransformer.

Various other types of sensing and control circuits are known and U.S. Pat. No. 3,590,316, dated June 29, 1971 to Engel et al. discloses a transistorized watt-meter which is used to control the duty cycle or to vary an impedance in order to control lamp wattage.

SUMMARY OF THE INVENTION

There is provided a composite structure which provides the dual functions of AC line voltage transformation as well as inductive reactance which can be controllably shifted in value, which structure serves as a part of a ballasting apparatus for a high-intensity, gas-discharge device. The structure comprises a multileg magnetic core member of predetermined dimensions and a primary winding having a predetermined number of turns is carried on a first leg portion of the core member. The primary winding has input terminals which are adapted to be connected to an energizing source of AC potential of predetermined magnitude and frequency. The structure includes an output winding having output terminals which are adapted to be connected in series circuit with the device to be operated and the output winding has a predetermined total number of turns to provide a predetermined output voltage, with at least a substantial and predetermined proportion of the total turns of the output winding carried on a second leg portion of the core member. A control winding having a predetermined number of turns is carried on a third leg portion of the control member. The control winding has input terminals, and non-magnetic gap means of predetermined dimensions are provided in the magnetic path which includes the third leg portion. The magnetic core member and the windings carried thereon have leakage flux paths of predetermined total permeance. A bilateral switch means has output terminals and a control terminal and the bilateral switch means has an open, non-conducting state and a closed, conducting state. The control winding terminals connect to the output terminals of the bilateral switch means and during normal operation of the ballasted device, the bilateral switch means is operable to be driven from an open, non-conducting state to a closed, conducting state at a variable but predetermined time in each half cycle of AC energizing potential. In operation of the device, when the bilateral switch means is in an open non-conducting state, a first predetermined value of inductive reactance is effectively provided in series with the ballasted device as normally operated as determined by both the magnetic path through the third leg portion and the flux in the leakage flux paths, in order to limit the current through the operating device to a first predetermined value. When the bilateral switch means is in a closed, conducting state, the third leg portion is effectively removed from circuit by virtue of the counter mmf generated therein, with the flux in the leakage flux paths effectively providing a second predetermined value of inductive reactance in series with the ballasted device as normally operated to limit the current therethrough to a second predetermined value. Thus by controlling the closing of the bilateral switch in each half cycle of energizing potential, the average power consumed by the operating device can be very carefully controlled.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
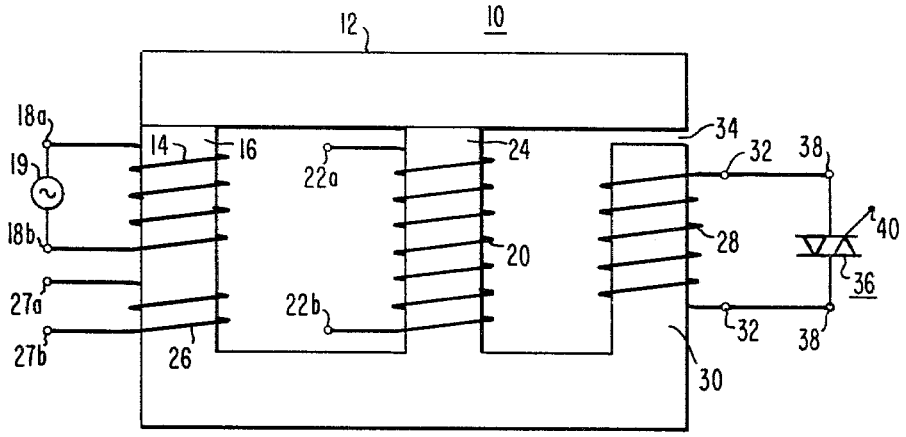
FIG. 1 is a diagrammatic showing of the present composite structure including the magnetic core member, the windings carried thereon, and the connected bilateral switch.

Both of the variable inductive devices as set forth in U.S. Pat. Nos. 3,873,910 and 4,162,428 require a separate input transformer in order to operate at different input voltages. In order to provide for voltage transformation as well as variable inductance, the present composite structure 10 as shown in FIG. 1 utilizes the natural leakage flux paths associated with any conventional iron structure in order to provide an effective value of ballasting inductance. The device 10 comprises a multileg magnetic core member 12 of predetermined dimensions. A primary winding 14 having a predetermined number of turns is carried on a first leg portion 16 of the core member 12. The primary winding has input terminals 18*a*, 18*b* which are adapted to be connected to an energizing source of AC potential of predetermined magnitude and frequency 19, an example being 120 volt, 60 Hz.

An output winding 20 has output terminals 22*a*, 22*b* which are adapted to be connected in series circuit with the device to be operated and the output winding has a predetermined number of total turns in order to provide a predetermined output voltage. In the device as illustrated, at least a substantial and predetermined proportion of the total turns of the output winding 20 are carried on a second leg portion 24 of the core member and the output winding 22 includes as a part thereof and in series circuit relationship therewith a small booster winding 26 in order to establish the proper output voltage, as will be explained in greater detail hereinafter. The booster winding 26 is provided with terminals 27*a*, 27*b*.

A control winding 28 having a predetermined number of turns is carried on a third leg portion 30 of the core member and the control winding is provided with input terminals 32. As shown, the control winding 28 is not connected to the primary winding 14 or the output winding 20. Non-magnetic gap means 34, such as an air gap, is provided in the magnetic path which includes the third leg portion 30. The magnetic core member and the windings carried thereon have leakage flux paths of predetermined total permeance.

A bilateral switch means 36, such as a conventional triac, has output terminals 38 and a control terminal 40. The bilateral switch means has an open non-conducting state and a closed, conducting state and the control winding terminals 32 connect to the output terminals 38 of the bilateral switch means. As will be explained hereinafter, after the lamp to be ballasted is normally operating, the bilateral switch means 36 is operable to be driven from an open non-conducting state to a closed conducting state at a variable but predetermined time in each half cycle of AC energizing potential.

When the bilateral switch means 36 is in an open non-conductive state a first predetermined value of inductive reactance is effectively provided in series with the ballasted device as normally operating as determined by both the magnetic path through the third leg portion 30 and the flux in the leakage flux paths, in order to limit the current through the operating device to a first predetermined value. When the bilateral switch means is in a closed conducting state, the third leg portion 30 is effectively removed from the circuit by virtue of the counter mmf generated therein, with the flux in the leakage flux paths effectively providing a second predetermined value of inductive reactance in series with the ballasted device as normally operated to limit the current therethrough to a second predetermined value.

Figure 2:
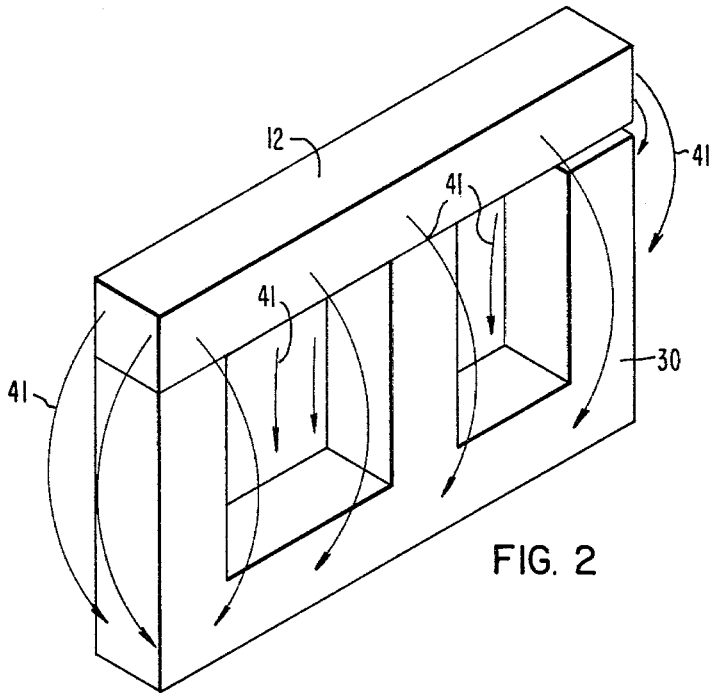
FIG. 2 is a diagrammatic representation, shown in isometric view, illustrating the leakage flux paths which are associated with the structure as shown in FIG. 1.

The leakage flux paths 41 which are associated with the wound core structure 12 as shown in FIG. 1 are diagrammatically illustrated in FIG. 2. Even when the third leg 30 is effectively removed from circuit by the counter mmf generated therein, the leakage flux paths 41 through and about this leg remain along with the other leakage flux paths as shown in FIG. 2.

Figure 3:
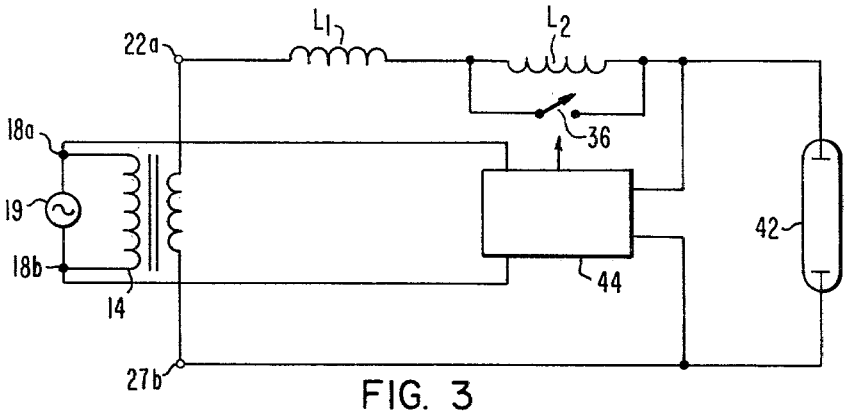
FIG. 3 is a diagrammatic representation of a lamp operating circuit which is equivalent to a lamp operating circuit which incorporates the composite structure of FIG. 1 for ballasting purposes.

The equivalent circuit of the structure as shown in FIG. 1, as connected in a lamp operating circuit, is shown in FIG. 3 wherein the input terminals 18*a*, 18*b* of the primary winding 14 are adapted to be connected across the energizing source 19 of AC potential and the output terminals 22*a*, 27*b* of the series-connected output winding 20 and the booster winding 26 are connected in series with the discharge device 42 to be operated. The inductor $L_1$ constitutes that inductive reactance which is due to the combined leakage flux paths of the circuit, as will be considered hereinafter. The inductor $L_2$ represents that inductance which is provided by the magnetic path through the third leg portion, which includes the non-magnetic gap 34 (see FIG. 1). With the bilateral switch 36 in a closed conducting state, the inductor $L_2$ is effectively shorted out of the circuit by virtue of the counter mmf generated in the third leg portion (30 in FIG. 1). This particular circuit is designed to utilize the control circuit 44 as shown in U.S. Pat. No. 4,162,429 and reference is made to this patent for details regarding the control circuit 44. During normal operation of the lamp 42, the bilateral switch 36 will be closed at a predetermined and variable time once each half cycle of AC energizing potential in order to effectively remove from circuit the ballasting inductor $L_2$. This circuit is responsive to variations in AC line voltage and variations in lamp operating voltage in order to control the average power input into the lamp 42.

Figure 4:
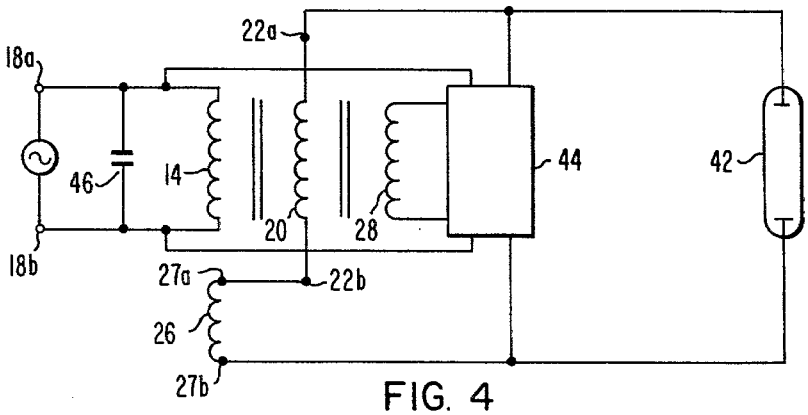
FIG. 4 is a diagrammatic showing illustrating practical connections in a ballast circuit for the composite structure as shown in FIG. 1.

The practical connections of the circuit as shown in FIG. 1 in a practical operating ballast are shown in FIG. 4 wherein the series-connected output winding 20 and booster winding 26 are connected in series with the lamp 42 to be operated and the control winding is connected to the bilateral switch (not shown) which is incorporated into the control circuit 44. An additional power-factor-correcting capacitor 46 connects across the input terminals 18*a*, 18*b* as is customary in such devices.

Figure 5:
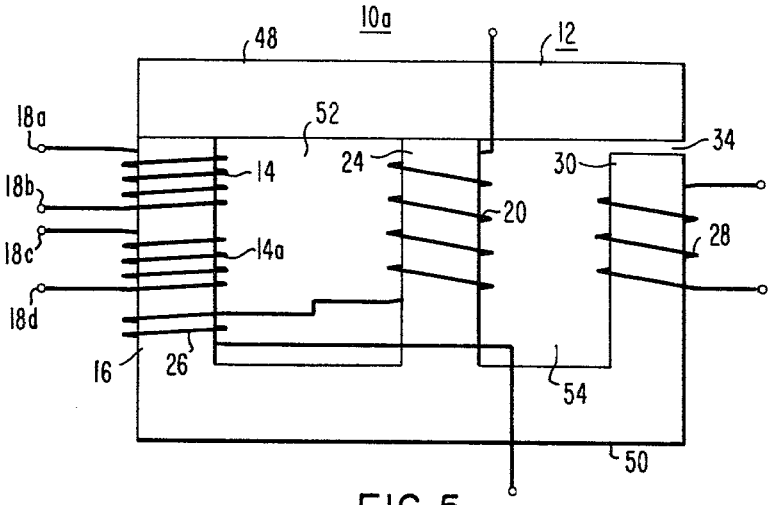
FIG. 5 is a diagrammatic showing of an alternative structure wherein the primary winding is split into two 120-volt windings in order to provide for operation from a 120-volt or 240-volt line.

In FIG. 5 is shown a modified device 10*a* which generally corresponds to the device 10 as shown in FIG. 1 except that the primary winding is split into two sections 14 and 14*a*. For operation across a 240-volt line, the primary windings 14 and 14*a* are connected in series at input terminals 18*b* and 18*c*. For operation across a 120-volt line, the primary windings 14 and 14*a* are connected in parallel. In other respects, the embodiment 10*a* is identical to the embodiment 10 as shown in FIG. 1.

The design of the composite device 10 as shown in FIG. 1 will vary depending upon the lamp to be ballasted and the design will be tailored to fit the desired operating parameters for a specific lamp. Considering in detail a 250-watt high-pressure sodium-vapor lamp with a maximum permissible operating wattage of 280 and a minimum permissible operating wattage of 180, the normal lamp voltage spread at the start of life should be in the range of 95 to 110 and at the end of life, the lamp should display a voltage thereacross of approximately 140 volts. The minimum ballast open-circuit voltage needed for proper operation is 180 volts and the starting current desired for such a lamp is in the range of 3 to 4.5 amps. Such a lamp will normally have a power factor at 140 volts of approximately 0.7 and this will not vary appreciably.

Using the foregoing operating parameters, the minimum reactor drop needed can be calculated as 180 (minimum open circuit voltage) plus 18 (10% overvoltage on input) minus 140 volts (lamp voltage at end of life) which equals 58 volts reactor drop. With a lamp current of 2.5 amps at end of life, the inductive reactance (minimum) can be calculated as 60 millihenries.

Using the foregoing lamp parameters, the starting current of 4.5 amps and zero lamp voltage, the maximum inductor reactance can be calculated as 106 mH. Other values of ballasting inductance will fall between these two indicated values, so that the variable inductance of the device 10 should fall within the range of from 60 mH to 106 mH for the specific lamp under consideration.

The structure of the magnetic core desirably should match the overall dimensions of existing core structures. Modifying an existing core structure slightly to increase window dimensions will provide an E-I construction wherein all leg members 16, 24 and 30 as well as the bridging members 48 and 50 (see FIG. 5) have a width of $\frac{7}{8}$ inch (2.22 cm). The height of the window member 52 is $2\frac{5}{8}$ inches (6.67 cm) and the width of the window 52 is $1\frac{3}{4}$ inches (4.44 cm). The height of the window 54 is $2\frac{5}{8}$ inches (6.67 cm) and the width of the window 54 is $\frac{7}{8}$ inch (2.22 cm). The magnetic core member 12 is formed from magnetic iron laminations, typically of 28 gauge, and using a current density of 1300 amps/in$^2$ (201 amperes/cm$^2$), and a working flux density of about 10 kilogauss, the stack height can be calculated as approximately 2.5 inches (6.35 cm). Using the foregoing structure, the leakage for this structure can be readily calculated. Assuming that the control winding 28 is closed and has removed the controlled leg 30 from consideration, the permeance can be calculated as approximately 31.5 maxwells/ampere turn.

With respect to the individual windings, for 120 applied volts and assuming an operating flux density of 12K gauss, each of the primary windings 14 and 14*a* can be calculated as requiring 266 turns, and the leakage inductance referred to the primary can be calculated as 28 mH. With the control winding short circuited, the ballast circuit will display minimum inductance which corresponds to the 60 mH condition, as specified hereinbefore. The 60 mH inductance, however, is referred to the secondary and the required number of secondary turns is thus readily calculated as 389 turns. There is, however, some extra leakage due to the fact that the control leg 30 is not completely out of the circuit and a reasonable compromise for the secondary turns is 375. The open circuit secondary voltage is thus readily calculated as $375/266 \times 120 = 169$ volts. This is not enough voltage, however, since the basic lamp parameters are specified as requiring a minimum ballast open circuit voltage of 180 volts. This additional required 11 volts can readily be obtained by the booster winding 26 on the primary leg which is connected in series-additive relationship with the output winding 20.

Any suitable control winding 28 can be utilized to suit the design of the bilateral switch 36 which is employed. For the triac switch design which is desired to be used, the open circuit voltage should be less than 400 volts and the short-circuit current less than 8 amperes. If the control winding 28 is provided with 375 turns, these parameters will be met. To calculate the dimensions of the non-magnetic gap 34, the total permeance of the device with the control winding open circuited can be calculated as 60 maxwells/ampere turn. With the control winding short circuited, it has been previously noted that the total permeance is 31.5 maxwells/ampere turn, providing a desired permeance for the control leg of 28.5 maxwells/ampere turn. The required gap can be readily calculated as 0.194 inch (0.494 cm). The only remaining requirement is to calculate the required wire gauge and winding procedure. As indicated, even though the primary has been calculated for 120-volt input, it is preferable to provide two input windings which can be connected either in series or in parallel to provide for 120-volt or 240-volt input. Each of the two primary windings should have 266 turns of No. 16 AWG. The output winding has 375 turns of 17 AWG as does the control winding. The booster winding can be calculated as having 24 turns of 17 AWG.

Figure 6:
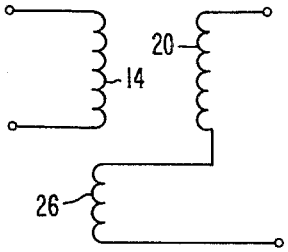
FIG. 6 is a diagrammatic showing of an alternative structure wherein the input winding and output winding are isolated and a small booster is provided on the input winding leg in order to achieve the desired output voltage.
Figure 7:
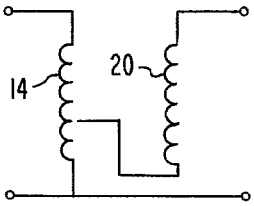
FIG. 7 is an alternative structure wherein the desired output voltage is achieved by means of an auto-transformer relationship between the input winding and the output winding.

For an isolated output, such as is described hereinbefore, the additional 11 volts required for minimum ballast open circuit voltage is readily obtained with the booster winding 26 in additive relationship, such as shown in the diagrammatic view of FIG. 6. As an alternative embodiment, the additional 11 volts could be obtained by tapping the 266 turn primary winding to provide an autotransformer connection 56, such as shown diagrammatically in FIG. 7. With the proper series of design variations and calculations, the proper minimum ballast open-circuit voltage should be attainable without the booster winding 26.

Figure 8:
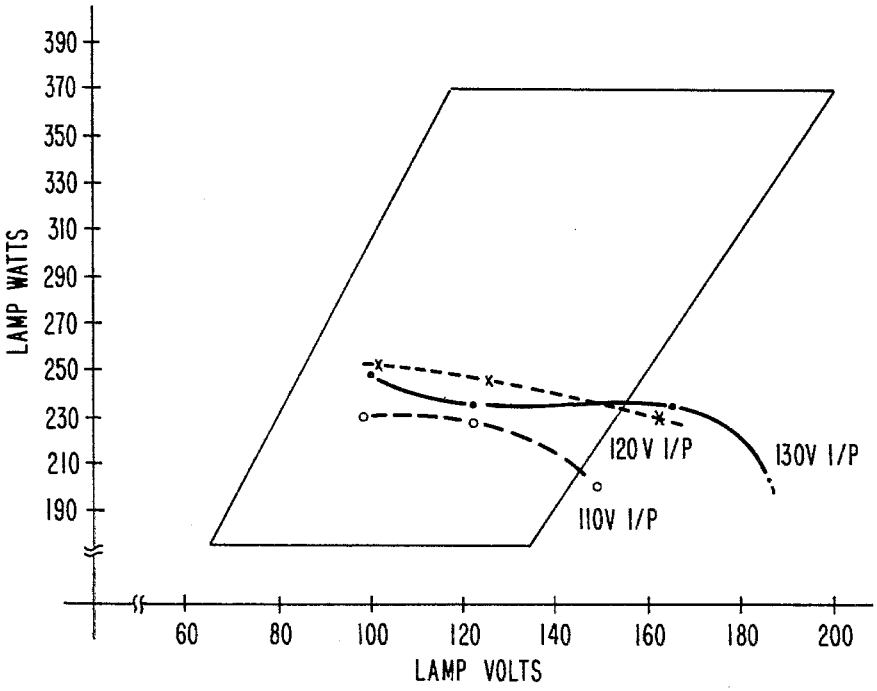
FIG. 8 shows performance characteristics for a 250-watt high-pressure-sodium lamp operated by the present ballasting device.

With the present composite structure connected in circuit with the control device as shown in heretofore referenced U.S. Pat. No. 4,162,429, the lamp performance characteristics for the 250-watt lamp specified are shown in FIG. 8. The trapezoid shown in this FIG. 8 is the present ANSI trapezoid for this type of lamp. Performance at 10% undervoltage is shown as a dashed line, performance at 10% overvoltage is shown as a solid line, and performance at rated voltage is shown as a dotted line. In all cases, the power input from start to end of lamp life is quite constant, which is a very desirable operating characteristic for best lamp performance of this type of lamp.

Figure 9:
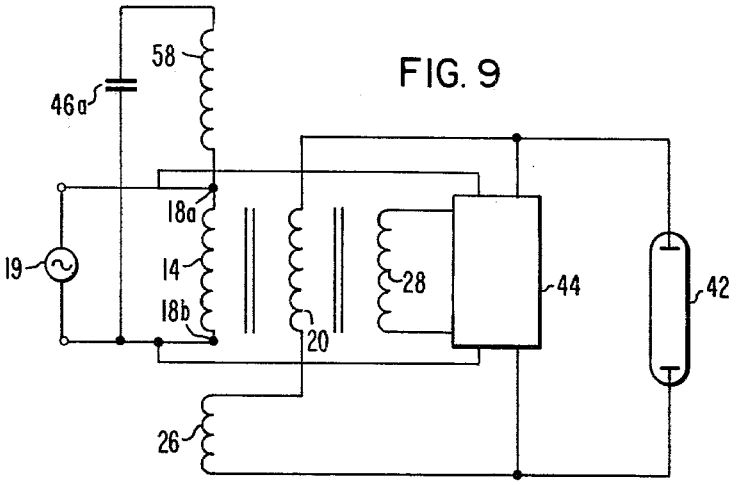
FIG. 9 is a diagrammatic view of an alternative structure wherein the input winding is provided with an overwind in order to reduce the value of capacitive reactance needed for power factor correction.

A modified structure is shown in FIG. 9 wherein the primary winding 14 is provided with an overwind 58 having a predetermined number of turns such as 386 turns and connecting to one of the input terminals 18*a* of the primary winding 14. A power-factor-correction capacitor 46*a* of predetermined reactance connects across both the primary winding 14 and the overwind 58. In this manner, for a structure such as described hereinbefore, the capacitive reactance required for the capacitor to achieve proper power-factor correction can be decreased from 30 $\mu$F, as normally required, to 5 $\mu$F.

Figure 10:
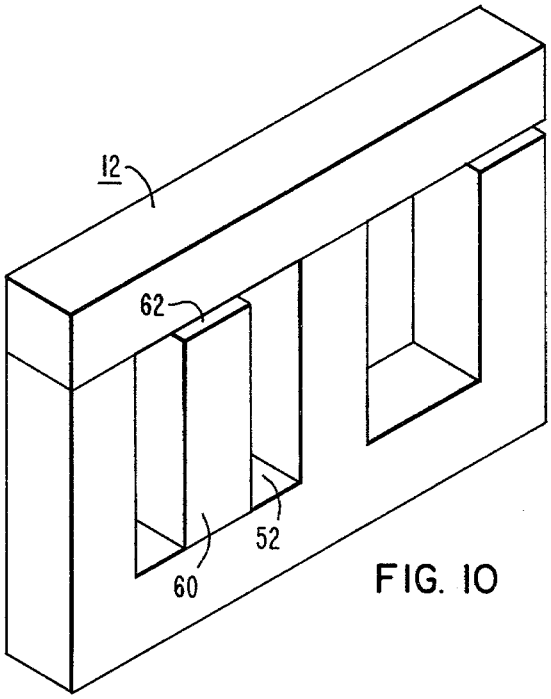
FIG. 10 is an isometric view of a magnetic structure generally corresponding to the magnetic structure as shown in FIG. 1, but wherein a supplemental magnetic shunt is provided in a flux leakage path to increase the effective leakage path permeance for the composite device.
Figure 11:
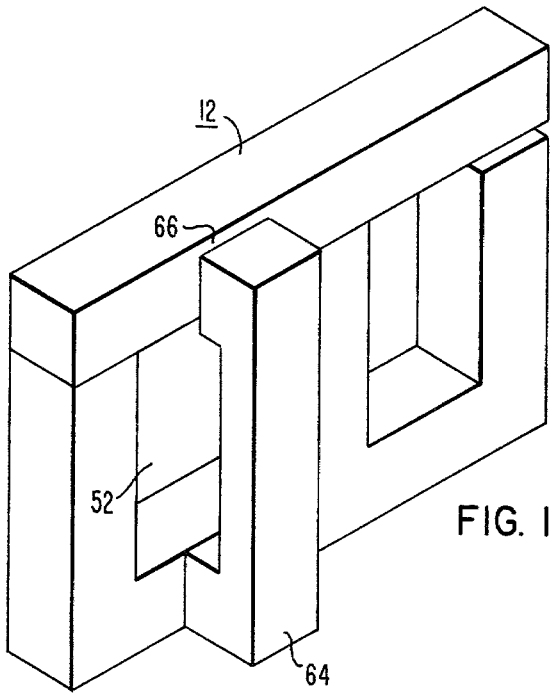
FIG. 11 corresponds to FIG. 10 but illustrates an alternative magnetic shunt to increase the effective leakage path permeance.
Figure 12:
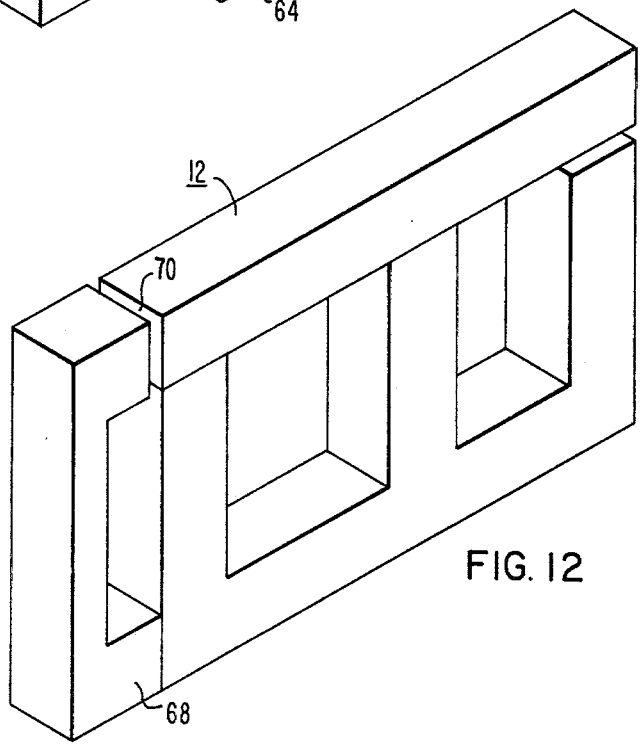
FIG. 12 generally corresponds to FIG. 10 but illustrates another alternative magnetic shunt in order to increase the effective leakage path permeance.

As a possible alternative construction, one or more of the flux leakage paths 41 of the wound core member (see FIG. 2) can have provided therein supplemental magnetic shunts in order to increase by a predetermined amount the total effective leakage path permeance of the wound core member. Such structures are shown in FIGS. 10–12 wherein in FIG. 10, an internal shunt 60 which incorporates an air gap 62 is positioned within the window 52 of the core structure 12. In the embodiment as shown in FIG. 11, a modified shunt 64 which incorporates an air gap 66 occupies one of the leakage paths which is external to the window 52. In the embodiment shown in FIG. 12, a paralleling shunt 68 which incorporates an air gap 70 extends from an end portion of the core structure 12 in order to increase the effective leakage path permeance of the wound core structure.

While the present composite structure has been described for operation in conjunction with a control circuit as set forth in U.S. Pat. No. 4,162,429, it should be understood that the present composite structure can be utilized in conjunction with many different types of control circuits which can be designed to sense a wide variety of lamp operating conditions or line voltage variations, or both, in order to control the lamp operation in a predetermined fashion. Also, while the present multileg magnetic structure has been provided with a conventional E-I configuration, other conventional magnetic configurations can be substituted therefor.

The present composite structure has been carefully tailored to the desired operating characteristics for a specific 250 watt high-pressure-sodium lamp. The structure can readily be modified in design details for other types of high-pressure-sodium lamps or to ballast other types of discharge devices.

I claim:

1. A composite structure which provides the functions of AC line voltage transformation as well as inductive reactance which can be controllably shifted in value, said structure having utility as a part of ballasting apparatus for a high-intensity gas-discharge device, said structure comprising:

(a) a multileg magnetic core member of predetermined dimensions, a primary winding having a predetermined number of turns carried on a first leg portion of said core member, said primary winding having input terminals adapted to be connected to an energizing source of AC potential of predetermined magnitude and frequency;

(b) an output winding having output terminals adapted to be connected in series circuit with said device to be operated, said output winding having a predetermined total number of turns to provide a predetermined output voltage, and at least a substantial and predetermined proportion of said total turns of said output winding carried on a second leg portion of said core member;

(c) a control winding having a predetermined number of turns carried on a third leg portion of said core member, said control winding having input terminals and said control winding being unconnected to said primary winding or said output winding, nonmagnetic gap means of predetermined dimensions provided in the magnetic path which includes said third leg portion, and said magnetic core member and said windings carried thereon having leakage flux paths of predetermined total permeance;

(d) bilateral switch means having output terminals and a control terminal, said bilateral switch means having an open non-conducting state and a closed conducting state, said control winding input terminals connect to the output terminals of said bilateral switch means, and during normal operation of said ballasted device said bilateral switch means is operable to be driven from an open non-conducting state to a closed conducting state at a variable but predetermined time in each half cycle of AC energizing potential; when said bilateral switch means is in an open non-conducting state, a first predetermined value of inductive reactance is effectively provided in series with said ballasted device as normally operating as determined by both the magnetic path through said third leg portion and the flux in said leakage flux paths in order to limit the current through said operating device to a first predetermined value; and when said bilateral switch means is in a closed conducting state, said third leg portion is effectively removed from circuit by virtue of the counter mmf generated therein with the flux in said leakage flux paths effectively providing a second predetermined value of inductive reactance in series with said ballasted device as normally operated to limit the current therethrough to a second predetermined value.

2. The composite structure as specified in claim 1, wherein said device to be ballasted in a high-pressure-sodium discharge device.

3. The composite structure as specified in claim 2, wherein said primary winding and said output winding are isolated, a small and predetermined proportion of said total turns of said output winding are carried on said first leg portion of said core member, and the remaining turns of said output winding are carried on said second leg portion of said core member.

4. The composite structure as specified in claim 1, wherein said output winding and said primary winding are connected in autotransformer relationship.

5. The composite structure as specified in claims 3 or 4, wherein said core member has an E-I configuration.

6. The composite structure as specified in claim 1, wherein a power factor correction capacitor of predetermined reactance is connected across said input terminals of said primary winding.

7. The composite structure as specified in claim 1, wherein said primary winding is provided with an overwind having a predetermined number of turns and connecting to one of said input terminals of said primary winding, and a power factor correction capacitor of predetermined reactance is connected across both said primary winding and said overwind.

8. The composite structure as specified in claim 1, wherein at least one supplemental magnetic shunt is provided in at least one flux leakage path of said wound core member in order to increase by a predetermined amount the total effective leakage path permeance of said wound core member.

* * * * *